United States Patent [19]

Hartje

[11] Patent Number: 4,917,648

[45] Date of Patent: Apr. 17, 1990

[54] TOY SANITATION TRUCK

[76] Inventor: Robert A. Hartje, 359 Mountainview Ter., Dunellen, N.J. 08812

[21] Appl. No.: 230,045

[22] Filed: Aug. 9, 1988

[51] Int. Cl.[4] ..... A63H 33/30; A63H 17/12; A63H 17/14

[52] U.S. Cl. ..... 446/424; 446/425; 446/427

[58] Field of Search ..... 446/425-428; 15/83, 340.1, 340.2, 340.3, 340.4

[56] References Cited

U.S. PATENT DOCUMENTS

| | | | |
|---|---|---|---|
| 959,380 | 5/1910 | Otis | 15/340.3 |
| 2,492,495 | 12/1949 | Nelson | 15/340.1 |
| 3,160,908 | 12/1964 | Peabody et al. | 15/340.1 |
| 3,204,280 | 9/1965 | Campbell | 15/340.3 |
| 3,233,274 | 2/1966 | Kroll | 15/340 |
| 3,242,521 | 3/1966 | Young | 15/340.3 |
| 3,348,258 | 10/1967 | Daneman | 15/340.1 |
| 3,444,583 | 5/1969 | Laurel | 15/340.3 |
| 3,506,998 | 4/1970 | Perry | 15/340.1 |
| 3,579,899 | 5/1971 | Hannah | 446/427 |
| 3,604,051 | 9/1971 | Wendel | 15/340 |
| 3,860,991 | 1/1975 | Heidt | 15/4 |
| 4,207,647 | 6/1980 | Masters | 15/340.1 |

FOREIGN PATENT DOCUMENTS

| | | | |
|---|---|---|---|
| 935537 | 10/1955 | Fed. Rep. of Germany | 446/425 |

*Primary Examiner*—Mickey Yu
*Assistant Examiner*—Michael Brown
*Attorney, Agent, or Firm*—William T. Hough

[57] ABSTRACT

A toy sanitation truck having forwardly pivoting arms carrying a pivotable cleaning structure mounting a sponge thereon for being pushed along in front of the truck, pivoted forwardly from mounting positions on opposite sides of the truck and with the arm pivotable rearwardly over and toward the aft portions of the body structure that embodies a cleaning brush revolvable by a power pack of batteries to power an electric motor that drives the brush and that also drives a vacuum cleaner pump having an inlet port facing the bottom rearward portions of the brush and having a dust or debris collector within the body space. The aft portions of the body have a lid portion that may be opened to gain access to the interior in which there is mounted a water container vessel in which water may drip or drain from the rearwardly-pivoted sponge and for gaining access to the dust storage structure of the vacuum cleaner inner structure. Also the rear wheels of the toy truck are drivable through gear connections by the electric motor. There is provided an off-on switch for turning on and off alternately, the motor. A biasing spring holds the pivoted arms downwardly in each of alternately pivoted positions.

21 Claims, 2 Drawing Sheets

TOY SANITATION TRUCK

This invention is directed to a toy sanitation truck symbolic of a municipal type sanitation truck, for the education and enjoyment of children.

FIELD OF THE INVENTION

1. Prior Art

While there does not appear to exist any patents nor other prior art directed to either toys or to real sanitation trucks that have the particular arrangements of this invention, some patents though not considered relevant, include the following:

The Hollowell U.S. Pat. No. 4,535,501 granted Aug. 20, 1985 discloses a battery powered real vacuum trash collector in which the vacuum tube extends over the cab for sucking debris through the long vacuum tube to a dust collector carried on a rearward portion of the vehicle that provides driving and riding space and a battery-powered motor within the vehicle structure. Another such patent is the Wendel U.S. Pat. No. 3,604,051 which discloses a powered sweeping machine that has a sweeping brush that may be lifted from the forward position to slightly upwardly to a slightly-suspended state forward of the riding position; the structure associated with the broom carries its own debris collector directly behind the broom, the collector also being pivotable upwardly with the sweeping brush prior to dumping. The Heidt U.S. Pat. No. 3,860,991 discloses a trailer truck type arrangement in which the trailer truck embodies a large brush and a small brush, and a lifter, and a storage compartment for storage of debris. The Kroll U.S. Pat. No. 3,233,274 is another sweeper vehicle having a rearward riding position and having an out-front brush and having a pivoted arm mounted on a right side of a vehicular machine, the machine embodying its own driving motor.

2. Background

Prior to the present invention, there has not existed a toy of this nature of this invention, by which children might participate with their mother in at least simulated assistance in the cleaning of the rug or carpet or the like, while joining with such commendable imitating acts of cleaning-up and having fun with such symbolic cleaning sanitation truck. The present invention seeks to avoid infantile approaches to toys to children which are totally frivilous and devoid of teaching social and wholesome attitudes and real-life symbolic structures and operations.

OBJECTS OF THE INVENTION

Accordingly, objects of the invention include achieving goals of the type discussed above, including providing an educational mechanized toy in the nature of a house cleaning mechanized device.

Another object is to provide a toy that is within the capability of understanding and operating safely while learning by self-instruction while playing with the toy.

Another object is to enhance wholesome attitudes of cleanliness and of participation with a parent in maintaining a neat and clean home or environment.

Another object is to provide a toy, while having the attributes of a teaching toy as noted above, nevertheless is sufficiently simple as to entertain children and retain their attention.

Other objects become apparent from the preceding and following disclosure.

One or more of the preceding objects are obtained by the invention as described above and hereinafter.

SUMMARY OF THE INVENTION

Broadly the invention is directed to a toy sanitation truck described as follows. There is a truck structure having a shape that is symbolic of particularly a municipal sanitation truck. The truck structure has an integral cab and a rearward or aft-cleaning and housing structure with its respective left and right side faces thereof. There is a forward axle with spaced-apart wheels thereon mounted as a part of the structure on the lower face thereof, and likewise a rearward axle and spaced-apart wheels mounted thereon, also as an integral part of the structure. Additionally there are two spaced-apart lever arms, extending substantially parallel to one-another, each having an elongated longitudinal axis with a proximal end each having an opposite distal end. The lever arms extend in substantially parallel relationship with one-another with proximal ends thereof mounted respectively on opposite ones of the left and right side faces above-noted, pivotably adapted for pivoting forwardly and aftwardly alternately. When pivoted aftwardly, the lever arms are located substantially overhead of the main portion of the truck structure extending substantially toward the rear of the cab and above the aft-cleaning and housing structure. Additionally there is a symbolic cleaning structure mounted on the distal ends of the lever arms, typically extending therebetween.

In a preferred embodiment, the symbolic cleaning structure is pivotably mounted on the respective distal ends of the lever arms, and includes a lever structure that limits the extent to which the symbolic cleaning structure will pivot rearwardly when the lever arms are forwardly pivoted, and additionally limits the extend to which the cleaning structure will pivot forwardly when the lever arms are rearwardly pivoted.

In another preferred embodiment, there is included a toggle-type tensioning mechanism for alternately tensioning the lever arms in alternately the forwardly pivoting position and alternately the lever arms in the opposite aftwardly-pivoted position. The toggle-type mechanism is mounted on at at-least one of the right and/or the left side faces of the truck structure.

In another preferred embodiment, the cab and aft-cleaning and housing structure form an open bottom and open space thereof between the forward and aft axles and wheels thereof on a lower face of the truck structure, and additionally includes a revolvable cleaning brush mechanism mounted between the left and right side faces of the truck structure, within the space of the open bottom, for brushing debris.

In another preferred embodiment, there included a motor mechanism for driving the revolvable cleaning brush mechanism. There is a motor-brush connector mechanism for driving the revolvable cleaning brush mechanism, and there is an electrical power source mechanism for driving the motor mechanism, operatively connected thereto. Also there is additionally a switching mechanism for turning off and on alternately, the motor mechanism, operatively connected to the motor mechanism.

In another preferred embodiment, there is included a vacuum mechanism adapted to suck-up and stored, that is brushed toward the vacuum mechanism by the cleaning brush mechanism. The vacuum mechanism includes an inlet structure that forms an inlet port. The inlet port substantially faces the reawardlly located lower face of the cleaning brush mechanism. The vacuum mechanism is operatively connected to and driven by a motor mechanism.

In another preferred embodiment, the cab and aft-cleaning and housing structure jointly include at-least one lid-portion as a part thereof, adapted to permit and gain access to upper interior space portions within the truck structure between the left and right sides thereof. The lid-portion is adapted to be alternately opened and closed for gaining that access. There also is included a water-storage vessel within the cab and aft-cleaning and housing structure, and there is accessibility to the water-storage vessel and space thereof when the lid(s)-portion(s) is/are position in the open state.

In another preferred embodiment, the lever arms are of lengths, as measured from points of pivot thereof from the proximal ends thereof, such that there is provided a forward symbolic cleaning structure when pivoted forwardly, and such that the cleaning structure is positioned above the water-storage vessel when the lid(s)-portion(s) is/are in an open state and the lever arms and cleaning structure thereof are pivoted rearwardly.

In another preferred embodiment, the symbolic cleaning structure includes a water-absorbing sponge. In this embodiment, when the symbolic cleaning structure is pivoted rearwardly, water within the sponge will drain directly into the water-storage vessel as a result of the rearwardly-positioned location above the water-storage vessel.

In another preferred embodiment, the vacuum mechanism includes a vacuum outlet vent, and has an air filter mounted across the venting space of the vacuum outlet vent.

In another preferred embodiment, there is included a motor-wheel drive mechanism connected between the motor mechanism and the rearward axle and wheels thereof, operatively connected for driving the rearward axle and wheels thereof by the motor mechanism.

In another preferred embodiment, the cab and aft-cleaning and housing structure form(s) an open bottom between the forward and rearward axles and wheels mounted thereon, there is included a revolvable cleaning brush mounted mechanism mounted between the left and right side spaces within the space of the open bottom of the cab and aft-cleaning and housing structure.

The invention may be better understood by making reference to the Figures as follow.

THE FIGURES

FIG. 1 diagrammatically and symbolically discloses a side view of a preferred embodiment of this invention with partial cut-aways for improved illustration thereof.

FIG. 2 illustrates a top view of the same preferred embodiment of FIG. 1, in elevation plan view, the FIG. 2 better illustrating the spaced-apart relationship of the lever arms and other features not clearly discernible in FIG. 1.

DETAILED DESCRIPTION

Figure 1:
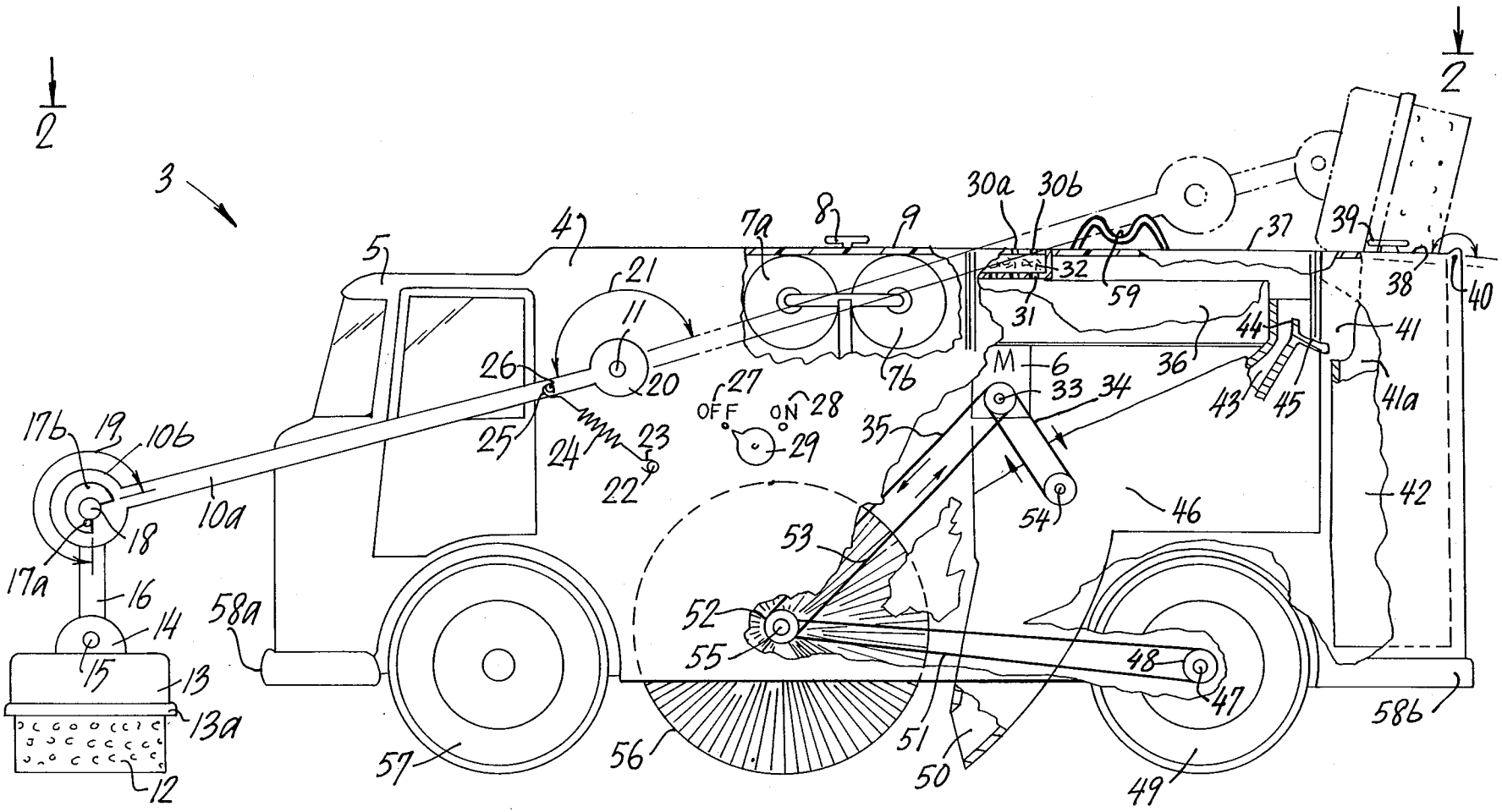
Figure 2:
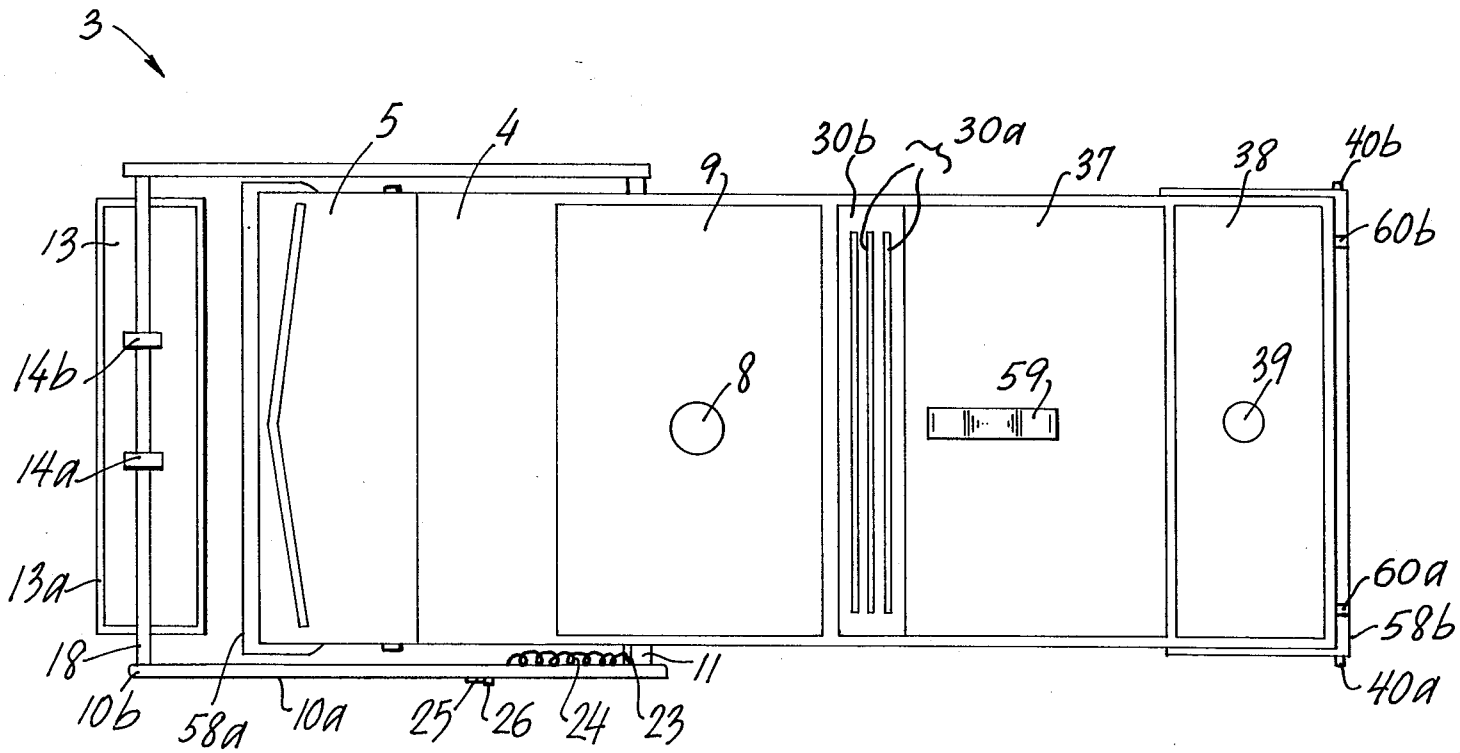

With reference to FIGS. 1 and 2, these figures disclose a common preferred embodiment, and accordingly disclose identical indicia insofaras disclosed in both figures.

In FIG. 1, there is shown the symbolic and diagrammatic truck 3, with the forwardly located cab 5 and the aftwardly located cleaning-structure and housing-structure 4. For driving one or more parts of this vehicle as previously noted, there is provided motor M designated 6.

To provide electrical power to the motor, by a conventional circuitry not disclosed herein, there are diagrammatically and symbolically represented the removable batteries **7*a* and 7*b*, in a compartment having a lid 9 with a handle 8 thereto. In FIG. 1, there is disclosed the left lever arm of the lever arms 10*a*, the other lever arm being also disclosed in the FIG. 2. In FIG. 1, there is also shown the details of a limiting device which prescribes and limits the extent of pivot of the supporting arm 16 in its pivot within the angle 19 on the axis 18 by virtue pivoting within the space 17*b* of the structure 10*b* that is an integral part of the lever arms 10*a*. Mounted on a distal end of the arm 16 is the pivoting structure 14 pivotally mounted on the pin 15, pivoting structure 14 having non-pivotally secured thereto the sponge structure 13 and 13*a*, carrying the sponge 12. The lever arms 10*a* are pivoted on the pin 11 at the proximal end of the lever arms, through the arcuate angle 21, from the forwardly illustrated position to the position shown in phantom for the aftwardly-located position. Mounted on at-least one face such as the left side face of the toy truck, is an anchoring pin or other anchoring structure 23 having attached thereto typically a hook-like end 22 of a spring 24, and having an opposite-end hook-like structure 25 fastened to another key 26, whereby in either of the forwardly or aftwardly pivoted positions, the spring 24 biases the lever arms 10*a* into its position whether it be the forward position or alternately the aftward-position. Mounted on the truck structure, there is a symbolic front bumper 58*a* and likewise on the back end of the truck there is a symbolic rear bumper 58*b*. For the motor 6, there is an on-off switch with its lever 29 for manually adjusting or operation thereof, and the off-position 27 and the on-position 28. There are the front wheels (only the left one—wheel 57—of identical wheels being illustrated) and there are rearward wheel (only the left one—wheel 49—of identical wheels being illustrated), each mounted on their respective forward and rearward axles in conventional manner and arrangement. Also illustrated in FIG. 1 is the rotatable brush 56 pivotally rotatable on an axis 55 by virtue of an attached pulley mechanism 52, the pulley 52 being driven by drive belt 53 from the motor drive 33 which also drives a belt 34 to drive the pulley 54 of the vacuum pump 46. The back axle 47 is driven by pulley 48 driven by belt 51 mounted on and driven by the axle or drive thereof 55. The vacuum pump 46 has an inlet port 50 and an outlet port 43 and a water-drainage guide-structure 45 guiding any liquid draining rearwardly through space and opening 41 of liquid-containing vessel 42. Driven air from the vacuum pump passing through the space 43 passes the liquid barrier 44, upwardly and through space of dust or debris-retaining vessel 36, and the compressed air passes upwardly through openings 31 through the filter material 32 and through the exiting apertures 30*a* and 30*b* and the like. There is an arm-support structure 59 located on the top surface of the aft-truck structure. Also there is the removable lid-portion 37. Either as a separate lid 38 or combined with the lid-portion 37, the lid 38 here-illustrated as a separate lid, has its separate handle 39 for removing the lid, which lid 38 is pivoted for rearward pivot thereof on a rearward pivot pin 40**.

It should be noted that by pivoting the arm 16 approximately 90 degrees forwardly, the distal ends of the pivot arms 19*a* are thereby permitted to become lowered to a lower level of substantially the surface on which the wheels 57 and 49 ride. Accordingly, in that position or state of being, if the truck is driven or pushed forwardly, the sponge 12 would serve as a snow pusher or snow-plow or dirt plow or the like, for pushing debris. It should be noted that while the off-on switch is shown to commonly control the motor 6 and the driving of the brush 56 and of the axle 47 and wheel 49, that other embodiments of this invention do not necessarily include the concurrent driving of all of these elements at the same time; it would be within the ordinary skill of this invention to add separate levers and alternate drive mechanisms whereby one or more thereof may alternately be driven separately.

While the invention has been above-described with regard to each and both of FIGS. 1 and 2, some features are better seen by reference to FIG. 2 which is a top view of the truck of FIG. 1, such as the arrangements of the support members 14*a* and 14*b* pivotally mounted on the bar or pin 18, and the structure 13 affixed to the support members 14*a* and 14*b*, with the sponge-receiving structure 13*a* that mounts the sponge 12. Also the relationship of the other elements previously described are better shown, including both hinge-structures 60*a* and 60*b*, and the opposite hinge-pin ends 40*a* and 40*b*, and the like.

Likewise it is within the scope and contemplation of this invention, to make other variations and substitution of equivalents, that would be obvious to a person of ordinary skill in this art.

I claim:

1. A toy sanitation truck comprising in combination: a truck structure of a shape symbolic of a municipal utility sanitation truck having an integral housing means with left and right side faces thereof with forward axle and wheels and with a rearward axle and wheels as an integral part thereof, said integral housing means including a cab, an aft housing structure forming a space having an upper portion thereto and located substantially between said forward and rearward axles, a water-storage vessel, at-least one lid-portion for gaining access to said upper portion of said space, the lid-portion being adapted to be alternately opened and closed for gaining access to said upper interior portion, and an aft-cleaning means for effecting a cleaning function of treating or cleaning a substrate surface, the cab having a cab-rear, and a water absorbing sponge; two pin-structures, different ones thereof located on each of opposite ones of said left and right side faces, and two spaced-apart lever arms, each having an elongated longitudinal axis with a proximal end and with a distal end, the lever arms extending in parallel relationship to one-another and said proximal ends thereof being mounted respectively at said pin-structures pivotally adapted for pivoting the lever arms forwardly and aftwardly overhead toward the cab-rear, toward the aft-cleaning means and toward the housing structure, to an aftward pivoted position rearward of said pin-structures, and when said lever arms are pivoted rearwardly, excess water within the sponge being drainable directly into said water-storage vessel; said aft-cleaning means being constructed and shaped to be symbolic of at-least one structure having an actual cleaning function, mounted on said distal ends.

2. A toy sanitation truck comprising in combination: a truck structure of a shape symbolic of a municipal utility sanitation truck having a housing means with left and right side faces thereof with forward axle and wheels and with a rearward axle and wheels as an integral part thereof, said housing means including a cab, an aft housing structure, and an aft-cleaning means for effecting a cleaning function of treating or cleaning a substrate surface, the cab having a cab-rear; a pair of lever arms connected to said housing means; two pin-structures that are pivotally adapted for pivoting the lever arms forwardly and aftwardly overhead toward said cab-rear toward the aft-cleaning means and toward the housing structure, to an aftward pivoted position rearward of said pin-structures; said aft-cleaning means being constructed and shaped to be symbolic of at-least one structure having an actual cleaning function, mounted on said distal ends of said lever arms and pivotable alternately between locations anterior of and rearward of said two pin-structures, and including a pivot-limiting means for prescribing the extent to which the aft-cleaning means will pivot rearwardly and forwardly, said pivot limiting means being an integral part of at least one of the distal end of the lever arms.

3. A toy sanitation truck of claim 2, in which said housing means forms an open bottom and space thereof between said forward and rearward axle and wheels, and includes a revolvable cleaning-brush means mounted between said left and right side faces within said space of said open bottom.

4. A toy sanitation truck of claim 3, in which at least one of said housing means includes at least one lid-portion as a part thereof for gaining access to upper interior portions of said space, the lid-portion being adapted to be alternately opened and closed for gaining access to said upper interior portions, and including a water-storage vessel within at-least one of said housing means accessible through open space made available when the lid-portion is in an open state.

5. A toy sanitation truck of claim 4, in which said lever arms are of lengths respectively, as measured from point(s) of pivot from said proximal ends thereof, such that said aft-cleaning means when pivoted rearwardly and when said lever arms are pivoted rearwardly, is positioned above said water storage vessel when said lid-portion is in an open state.

6. A toy sanitation truck of claim 2, including a toggle-type tensioning means for alternately tensioning the lever arms in a forwardly pivoted position and tensioning the lever arms in an aftwardly pivoted positions, mounted on at least one of said right and left side faces.

7. A toy sanitation truck of claim 6 in which said housing means forms an open bottom and space thereof between said forward and rearward axle and wheels, and including a revolvable cleaning-brush means mounted between said left and right side faces within said space of said open bottom for brushing debris.

8. A toy sanitation truck of claim 7, including a motor means for driving said revolvable cleaning-brush means; motor-brush connector means for driving said revolvable cleaning-brush means; an electrical power source means for driving said motor means, operatively connected to said motor means; and switch means for turning on and for turning off said motor means, operatively connected to said motor means.

9. A toy sanitation truck of claim 8, including a vacuum means for sucking-up and storing debris brushed toward the vacuum means by the revolvable cleaning-brush means, the vacuum means including inlet port structure forming an inlet port substantially facing a rearward lower face of said revolvable cleaning-brush means, operatively connected to and driven by said motor means.

10. A toy sanitation truck of claim 9, in which said vacuum means includes a vacuum outlet vent, and an air filter mounted across venting space of said vacuum outlet vent.

11. A toy sanitation truck of claim 2, including a motor-wheel drive means connected between said motor and said rearward axle and wheels, for driving said rearward axle and wheels by said motor means.

12. A toy sanitation truck comprising in combination: a truck structure of a shape symbolic of a municipal utility sanitation truck having housing means with left and right side faces thereof with forward axle and wheels and with a rearward axle and wheels as an integral part thereof, said housing means including a cab, an aft housing structure, and an aft-cleaning means for effecting a cleaning function of treating or cleaning a substrate surface, the cab having a cab-rear, and a water-absorbing sponge; two pin-structures, different ones thereof located on each of opposite ones of said left and right side faces, and two spaced-apart lever arms, each having an elongated longitudinal axis with a proximal end and with a distal end, the lever arms extending in parallel relationship to one-another and said proximal ends thereof being mounted respectively at said pin-structures that are pivotally adapted for pivoting the lever arms forwardly and aftwardly overhead toward said cab-rear, toward the aft-cleaning means and toward the housing structure, to an aftward pivoted position rearward of said pin-structures, and when said lever arms are pivoted rearwardly, excess water within the sponge being drainable directly into said water-storage vessel; said aft-cleaning means being constructed and shaped to be symbolic of at-least one structure having an actual cleaning function, mounted on said distal ends.

13. A toy sanitation truck of claim 12, in which said aftcleaning means is pivotally mounted on said distal ends of said lever arms and adapted to pivot alternately between locations anterior of and rearward of said pin-structures, and including a pivot-limiting means for prescribing the extend to which the aft-cleaning means will pivot rearwardly and forwardly, said pivot-limiting means being an integral part of structure of at least one of the distal ends and the aft-cleaning means.

14. A toy sanitation truck of claim 1, including a toggle-type tensioning means for alternately tensioning the lever arms in a forwardly pivoted position and tensioning the lever arms in an aftwardly pivoted positions, mounted on at least one of said right and left side faces.

15. A toy sanitation truck of claim 14, in which at least one of said housing means forms an open bottom and space thereof between said forward and rearward axles and wheels, and including a revolvable cleaning-brush means mounted between said left and right side faces within said space of said open bottom for brushing debris.

16. A toy sanitation truck of claim 15, including a motor means for driving said revolvable cleaning-brush; motor-brush connector means for driving said revolvable cleaning-brush means; an electrical power source means for driving said motor means, operatively connected to said motor means; and switch means for turning on and for turning off said motor means, operatively connected to said motor means.

17. A toy sanitation truck of claim 16, including a vacuum means for sucking-up and storing debris brushed toward the vacuum means by the revolvable cleaning-brush means, the vacuum means including inlet port structure forming an inlet port substantially facing a rearward lower face of said revolvable cleaning-brush means, operatively connected to and driven by said motor means.

18. A toy sanitation truck of claim 17, in which at least one of said housing means includes at least one lid-portion as a part thereof for gaining access to upper interior portions of said space, the lid-portion being adapted to be alternately opened and closed for gaining access to said upper interior portions, and including a water-storage vessel within said cab, said aft-cleaning structure, and the housing structure accessible through open space made available when the lid-portion is in an open state.

19. A toy sanitation truck of claim 18, in which said lever arms are of lengths respectively, as measured from point(s) of pivot from said proximal ends thereof, such that said aft-cleaning means when pivoted rearwardly and when said lever arms are pivoted rearwardly, is positioned above said water-storage vessel when said lid-portion is on an open state.

20. A toy sanitation truck of claim 12, in which said vacuum means includes a vacuum outlet vent, and an air filter mounted across venting space of said vacuum outlet vent.

21. A toy sanitation truck of claim 20, including a motor-wheel drive means connected between said motor and said rearward axle and wheels, for driving said rearward axle and wheels by said motor means.

* * * * *